US005100343A

United States Patent [19]

Peterson

[11] Patent Number: 5,100,343

[45] Date of Patent: Mar. 31, 1992

[54] ELECTRICAL CONNECTOR FOR FLOAT CONTROLLED PUMPS

[75] Inventor: Terry A. Peterson, Linwood, Kans.

[73] Assignee: The Marley Company, Mission Woods, Kans.

[21] Appl. No.: 554,376

[22] Filed: Jul. 19, 1990

[51] Int. Cl.[5] ..... H01R 11/00

[52] U.S. Cl. ..... 439/505; 439/638; 417/40

[58] Field of Search ..... 439/502, 505, 638, 639, 439/736, 577, 928, 624, 275, 197; 417/40

[56] References Cited

U.S. PATENT DOCUMENTS

| | | | |
|---|---|---|---|
| 2,653,219 | 9/1953 | Popp | 439/639 X |
| 2,748,359 | 5/1956 | Swan | 439/502 |
| 3,128,140 | 4/1964 | Stepheson, Sr. | 439/505 |
| 3,535,638 | 10/1970 | Michelin | 439/502 X |
| 3,897,172 | 7/1975 | Hall | 417/40 |
| 3,916,130 | 10/1975 | Cade | 439/197 X |
| 4,021,144 | 5/1977 | Matsusaka | 417/40 |
| 4,416,268 | 11/1983 | Hagino | 439/924 X |
| 4,961,018 | 10/1990 | Akhter | 439/275 X |

*Primary Examiner*—Larry I. Schwartz
*Assistant Examiner*—J. R. Daulton
*Attorney, Agent, or Firm*—Kokjer, Kircher, Bowman & Johnson

[57] ABSTRACT

A tee shaped electrical connector for a pump such as a sump pump having a pump motor controlled by a float switch. A power cord carrying a plug on one end extends from one leg of the connector body. A float switch cord extends to the float from another leg of the connector. The third leg of the connector includes electrical contacts to which the power cord and float switch wiring extend. Electrical terminal pins for the motor leads project into a socket on the pump so that the contacts and terminals connect electrically when the connector is applied to the socket.

18 Claims, 1 Drawing Sheet

ELECTRICAL CONNECTOR FOR FLOAT CONTROLLED PUMPS

BACKGROUND AND SUMMARY OF THE INVENTION

This invention relates generally to electrical connectors and more particularly to a molded connector having a construction which facilitates the assembly of the electrical connections for a float controlled pump such as a sump pump.

Electric sump pumps are commonly equipped with a float having a mercury switch or mechanical switch that automatically turns the pump motor on when the liquid in the sump rises to a preselected level. In the past, the electrical lead wires from the motor, the power cord and the float switch cord have all been extended into an electrical compartment on the pump housing, and the proper wires must then be connected with one another by hand in the electrical compartment; another arrangement that has been used involves the provision of a separate cord with the float switch attached and a separate plug with "piggy-back" connector for the purpose of attaching the pump power cord. As can easily be appreciated, this assembly technique requires considerable time and a reasonable amount of skill, and it is also possible for the electrical connections in the box to be faulty.

The present invention is directed to an electrical connector which is constructed in a unique manner in order to facilitate assembly of the electrical wiring, reduce the assembly time, and virtually eliminate faulty electrical connections in a float controlled electric pump. In accordance with the invention, a tee shaped electrical connector is molded in a single integral piece with the power cord molded to one leg of the connector body and the float switch cord molded to another leg. The final leg of the connector body has a plug head equipped with electrical contacts to which lead wires from the power cord and the float switch cord extend. The pump casing is provided with a socket into which electrical terminals for the motor leads project. The plug head may be inserted into the sockets so that the electrical contacts mate with the terminals, and the connector body may be fastened in place by two screws.

Due to this construction, all that is required for the electrical connections to be completed during the assembly process is to plug the connector into the socket and secure it with the screws. Because the connector body is prewired, the electrical circuit that results following assembly is properly arranged so that the float switch controls the on/off condition of the pump motor in the intended manner.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
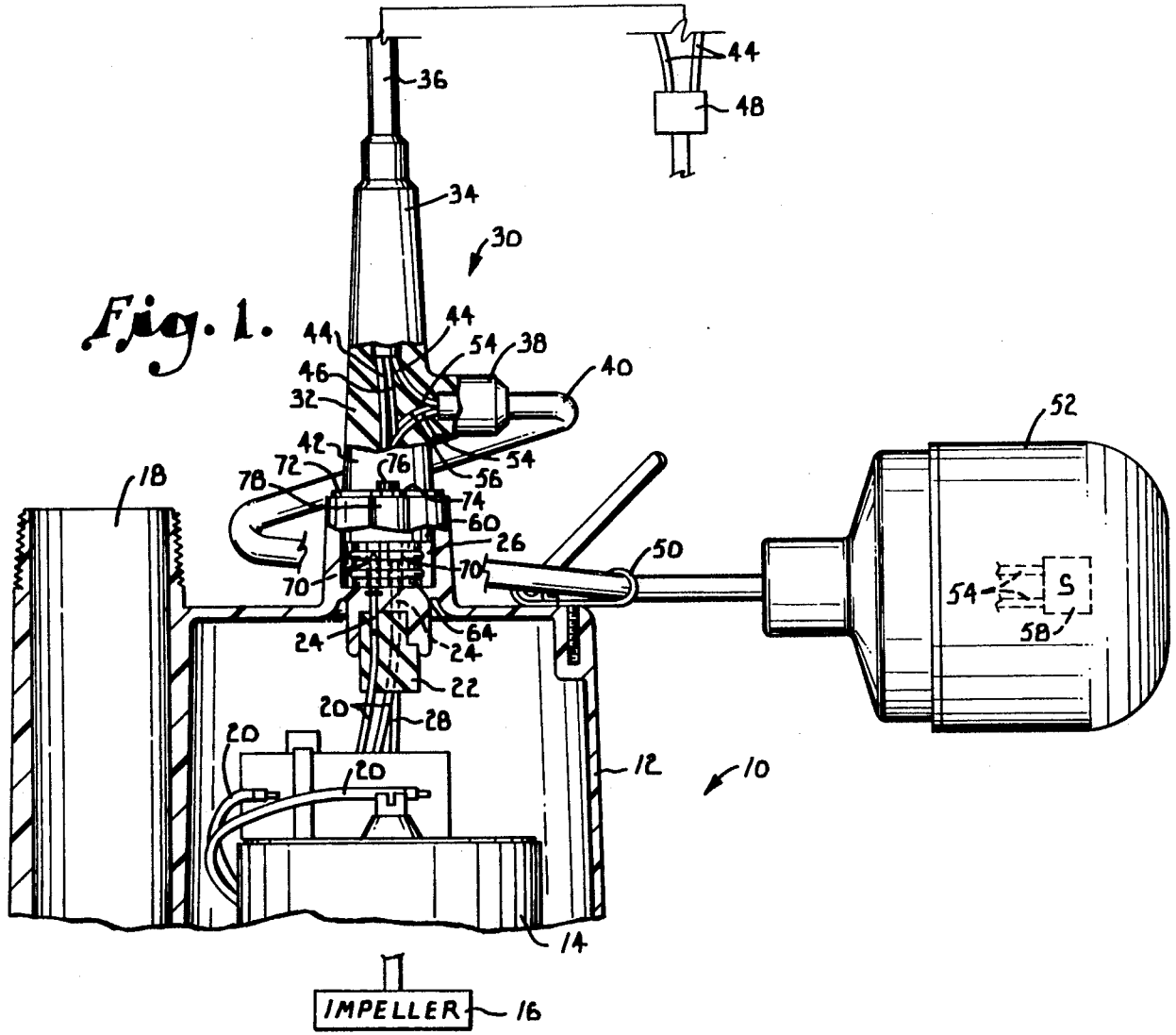
FIG. 1 is a fragmentary elevational view of a float controlled sump pump equipped with a tee shaped electrical connector constructed according to a preferred embodiment of the present invention, with portions broken away and other portions shown in section for purposes of illustration.

Referring now to the drawings in more detail and initially to FIG. 1, numeral 10 generally designates an electric sump pump which is typically installed in a sump and which pumps water or other liquid out of the sump when the level therein rises to a preselected level. The pump 10 includes a plastic pump casing 12 which houses a conventional AC electric motor 14. When the motor 14 is energized, it drives a pump impeller 16 which operates to pump liquid from the sump through a discharge 18 formed on one end of the pump casing 12. Normally, tubing is attached to the discharge 18 in order to direct the water to the desired location.

Electric current for operating the motor 14 is supplied by a pair of lead wires 20 which connect with the motor windings and extend into a block 22 located within the casing 12 near its top end. The motor leads 20 connect within the block 22 with respective terminal pins 24 which project upwardly from block 22 through the top of the motor casing into a cylindrical socket 26 located on top of the pump casing. A ground wire 28 is also provided and connects with a third terminal pin (not shown) which likewise projects into the socket 26. When voltage is applied across the two terminal pins 24 for the motor leads, electrical power is supplied to the motor 14 and the motor is then energized to drive the impeller 16.

In accordance with the present invention, a tee shaped electrical connector 30 is prewired and is constructed such that it can be plugged into the socket 26 in order to complete all of the electrical connections required for assembly of the pump. The connector 30 has a tee shaped body 32 which is constructed of a suitable plastic or rubber like material and which is molded in a single integral piece. The connector body 32 has one leg 34 from which a power cord 36 extends and another leg 38 from which a float switch cord 40 extends. The legs 34 and 38 are perpendicular to one another. The connector body 30 includes a third leg 42 which is perpendicular to leg 38 and in line with leg 34.

The power cord 36 is molded in leg 34 and extends axially therefrom. Extending within the power cord 36 are a pair of power leads 44 and a ground wire 46. A conventional electrical plug 48 is carried on the end of cord 36, and the power leads 44 and ground wire 46 connect with the prongs of the plug 48 in the usual way. The plug 48 may be plugged into a conventional power receptacle.

The float switch cord 40 is molded within leg 38 and extends axially from the end of the leg. The float switch cord 40 is held by a cord retainer 50 mounted on the pump casing 12, and a float 52 is carried on the end of the cord 40. Extending within the float switch cord 40 are a pair of electrical leads 54 and a ground wire 56. One of the leads 54 coincides with or is otherwise connected with one of the power leads 44 within the molded connector body 32. A conventional mercury or mechanical switch 58 is located in the float 52, and the two electrical leads 54 are connected across the switch 58.

The mercury or mechanical switch 58 closes when the float 52 is raised to a preselected angle, and this occurs when the water level in the sump reaches a preselected level at which the pump is to be activated. When the switch 58 is open, the two leads 54 are disconnected. However, when the switch 58 is closed, the two leads 54 are connected through the switch, and the circuit to the motor is thus completed as will be described more fully. The float 52 floats on top of the liquid in the sump in which the pump 10 is installed and thus responds to the liquid level in the sump.

Figure 2:
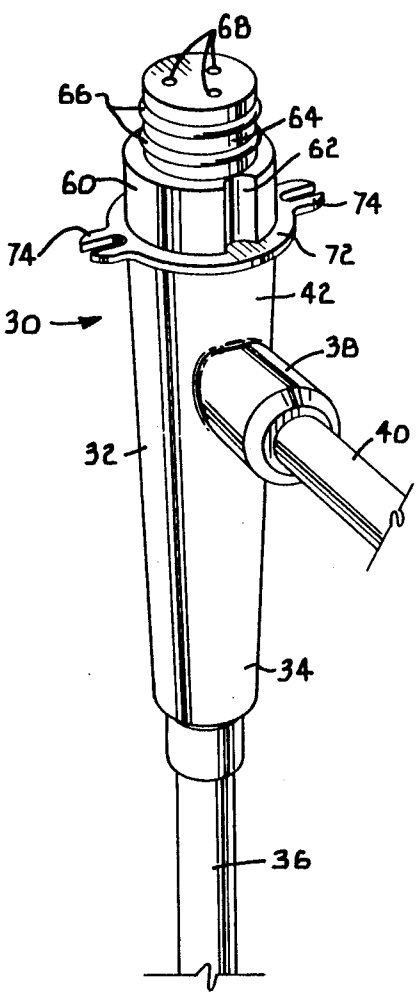
FIG. 2 is a fragmentary perspective view showing the electrical connector in an inverted position.

As best shown in FIG. 2, the third leg 42 of the connector body 32 includes a cylindrical barrel 60 having a size to fit closely in the socket 26. A groove 62 is formed in the barrel 60 to mate with a complemental rib (not shown) located within the socket 26. A cylindrical plug head 64 is integral with the end of the barrel 60 and is somewhat smaller in diameter than the barrel in order to fit loosely in the socket 26. A pair of circumferential ribs 66 are formed on the plug head 64.

The end face of the plug head 64 is provided with three recesses 68 (see FIG. 2), two of which are provided with metal sleeves 70 (FIG. 1) which serve as electrical contacts for the connector 30. The second power lead 44 extends to connection with one of the sleeves 70, while the second float switch lead wire 54 extends to connection with the other sleeve 70. The third recess 68 is provided with another metal sleeve (not shown) which connects with the ground wires 46 and 56.

A rigid annular ring 72 is fitted in an annular groove located adjacent to the barrel 60 on leg 42 of the connector body. A pair of slotted lugs 74 project from the ring 72 at diametrically opposed positions. Screws 76 (one of which is visible in FIG. 1) may be extended through the slots in the lugs 74 and threaded into openings formed in thickened areas 78 on the socket 26 in order to secure the electrical connector 30 in place on the pump 10.

The electrical connector 30 of the present invention is wired so that all that is necessary to complete the wiring for the pump 10 is to plug the leg 42 into socket 26 and secure the connector 30 by applying the screws 76. The fit of the groove 62 and the mating rib on the socket 26 assures that the connector will be oriented such that the two terminal pins 24 for the motor leads closely receive and electrically contact the two sleeves 70 which form the electrical contacts for the connector 30. In addition, the ground terminal pin fits in the third sleeve to provide electrical connection for the ground wires. After the barrel 60 has been fully inserted into the socket 26, the end face of the plug head 64 bottoms out in the socket, and the screws 76 may then be applied to fasten the connector in place on the pump.

In operation of the pump, the float switch 58 is normally open but closes when the float 52 tilts sufficiently due to the water level rising to the level at which the pump is to be activated. Then, an electrical circuit is completed from the plug 48 through one of the power leads 44 to the connected float switch lead 54, through switch 58 to the other float switch lead 54, through sleeve 70 and terminal pin 24 to one of the motor leads 20, through the motor to the other motor lead 20, back to the other terminal pin 24, the other sleeve 70 and the second power lead 44 back to the plug 48. This energizes the motor 14 and effects pumping of liquid through the discharge 18 until the float 52 has dropped sufficiently to cause the mercury or mechanical switch 58 to open. Then, the circuit to the motor is interrupted due to the open condition of the switch 58, and the motor is deenergized until the switch closes again in response to rising of the liquid level in the sump.

Because the power cord 36 and the float switch cord 40 are molded to the connector body 32, the cords have secure mechanical connections with the connector 30. At the same time, all of the wiring associated with the connector 30 is completed when the connector is formed, and all that needs to be done to complete the circuit for the pump motor 14 is plugging of the electrical connector into the socket 26.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without department from the scope thereof, it is to be understood that all matter herein set forth or shown in the accompanying drawings is to be interpreted as illustrative and not in a limiting sense.

Having thus described the invention, I claim:

1. An electrical connector for a pump which is controlled by a float and which has an electric motor and a pair of electrical terminals for supplying electrical power to the motor, said connector comprising:

a connector body having a first leg from which a power cord extends for connection with an electrical power source and a second leg from which a float cord extends to the float, said power cord and float cord having electrical leads;

a pair of electrical contacts on said connector body arranged to mate with said terminals and connected with said electrical leads of the power cord and float cord in a manner to permit power to be applied to the motor through the float when a switch in the float is closed; and means for connecting said connector body with the pump in a manner to electrically connect said contacts with said terminals, whereby the motor is energized through said cord leads, float cord leads and switch when the power cord is connected with the power source and said switch is closed.

2. The connector of claim 1, wherein said connector body is molded as an integral piece and said power cord and float cord are molded to said body.

3. The connector of claim 1, wherein said connector body has a tee shaped configuration and said first and second legs are generally perpendicular to one another.

4. The connector of claim 1, wherein said connecting means comprises a plug in connection between the connector body and pump.

5. The connector of claim 4, wherein said connecting means further comprises at least one fastener for securing said plug in connection.

6. The connector of claim 1, wherein said connecting means comprises:

a socket on the pump; and a plug head on said connector body for insertion into said socket.

7. The connector of claim 6, wherein said connecting means further comprises at least one fastener for securing the plug head in the socket.

8. The connector of claim 6, wherein:

said terminals comprise terminal pins projecting into said socket; and said contacts comprise sleeves on said plug head arranged to closely receive said terminal pins therein.

9. The connector of claim 6, wherein said connector body has a tee shaped configuration and presents a third leg on which said plug head is located.

10. An electrical connector for a pump having an electric motor controlled by a float switch and a pair of electrical terminals for supplying electrical power to the motor, said connector comprising:

a molded connector body applicable to the pump;

a power cord molded to said body and extending therefrom, said cord carrying a plug for connection with a source of electrical power and having a pair of power leads;

a float switch cord molded to said body and extending therefrom, said float switch cord having a pair of electrical float switch leads extending to the float switch with one of said electrical float switch leads being connected with one of the power leads within said connector body; and a pair of electrical contacts on said body respectively connected with the other power lead and the other electrical float switch lead, said contacts being arranged to connect with the terminals when said connector body is applied to the pump, whereby the float switch controls the application of electrical power to the motor.

11. The connector of claim 10, wherein said body has a generally tee shaped configuration presenting a pair of substantially perpendicular legs from which the power cord and float switch cord extend.

12. The connector of claim 11, including:

a socket on the pump in which the electrical terminals are located; and a third leg on said body having a plug head on which said electrical contacts are carried, said plug head fitting in the socket in a manner to correct said contacts with said terminals.

13. The connector of claim 12, wherein:

said terminals comprise terminal pins projecting into said socket; and said contacts comprise sleeves on said plug head arranged to closely receive said terminal pins therein.

14. The connector of claim 10, including means for establishing a plug in connection between the connector body and pump in a manner to maintain electrical contact between said contacts and terminals.

15. An electrical connector for an electric pump motor controlled by a float switch and having a pair of electrical terminals for supplying electric power to the motor, said connector comprising:

a generally tee shaped connector body having first, second and third legs molded integrally with one another;

a power cord molded to said body and extending from said first leg, said cord having a pair of power leads connected with a plug which is carried on the cord and which is applicable to a source of electrical power;

a float switch cord molded to said body and extending from said second leg, said float switch cord having a pair of electrical float switch leads connected across the float switch, one of said electrical float switch leads being connected with one of said power leads within said connector body;

a pair of electrical contacts on said third leg respectively connected with the other power lead and the other electrical float switch lead; and means for establishing a plug in connection between said third leg and the pump, said connection establishing electrical connection between said electrical contacts and terminals to make electrical power available to said motor through the float switch.

16. The connector of claim 15, wherein said plug in connection comprises:

a socket on the pump; and a plug head on said third leg having a size to fit in said socket.

17. The connector of claim 16, wherein:

said terminals comprise terminal pins projecting into said socket; and said contacts comprise sleeves on said plug head arranged to closely receive said terminal pins therein.

18. The connector of claim 16, including at least one fastener for securing said plug head in the socket.

* * * * *